US005860597A

United States Patent [19]

Tarr

[11] Patent Number: 5,860,597

[45] Date of Patent: Jan. 19, 1999

[54] INJECTION RATE SHAPING NOZZLE ASSEMBLY FOR A FUEL INJECTOR

[75] Inventor: Yul J. Tarr, Columbus, Ind.

[73] Assignee: Cummins Engine Company, Inc., Columbus, Ind.

[21] Appl. No.: 822,718

[22] Filed: Mar. 24, 1997

[51] Int. Cl.[6] ..... B05B 9/00; F02M 47/02

[52] U.S. Cl. ..... 239/124; 239/88; 239/96; 239/533.3; 239/585.1

[58] Field of Search ..... 239/88, 90, 91, 239/95, 96, 99, 124, 533.1, 533.2, 533.3, 533.4, 533.5, 533.8, 533.9, 585.1, 585.2

[56] References Cited

U.S. PATENT DOCUMENTS

| | | | |
|---|---|---|---|
| 2,959,360 | 11/1960 | Nichols . | |
| 3,680,782 | 8/1972 | Monpetit et al. | 239/533.8 X |
| 4,069,800 | 1/1978 | Kanda et al. . | |
| 4,249,497 | 2/1981 | Eheim et al. . | |
| 4,440,132 | 4/1984 | Terada et al. . | |
| 4,601,269 | 7/1986 | Kato et al. . | |
| 4,627,571 | 12/1986 | Kato et al. . | |
| 4,728,074 | 3/1988 | Igashira et al. . | |
| 4,784,101 | 11/1988 | Iwanaga et al. . | |
| 4,798,186 | 1/1989 | Ganser . | |
| 4,826,080 | 5/1989 | Ganser | 239/88 |
| 5,094,215 | 3/1992 | Gustafson . | |
| 5,133,645 | 7/1992 | Crowley et al. . | |
| 5,176,120 | 1/1993 | Takahashi . | |
| 5,209,403 | 5/1993 | Tarr et al. | 239/95 X |
| 5,421,521 | 6/1995 | Gibson et al. . | |
| 5,463,996 | 11/1995 | Maley et al. . | |
| 5,472,142 | 12/1995 | Iwanaga | 239/96 |
| 5,538,187 | 7/1996 | Mueller et al. | 239/533.9 X |
| 5,647,536 | 7/1997 | Yen et al. | 239/90 |
| 5,694,903 | 12/1997 | Ganser | 239/96 X |

OTHER PUBLICATIONS

Miyaki et al., "Development of New Electronically Controlled fuel Injection System ECD–U2 for Diesel Engines", SAE 910252.

*Primary Examiner*—Andres Kashnikow
*Assistant Examiner*—Robin O. Evans
*Attorney, Agent, or Firm*—Sixbey, Friedman, Leedom & Ferguson; Charles M. Leedom, Jr.; Tim L. Brackett, Jr.

[57] ABSTRACT

An improved nozzle assembly for servo-controlled fuel injectors is provided which includes a needle valve control device including a rate shaping control device for effectively producing a predetermined time varying change in the flow rate of fuel injected into the combustion chamber during an injection event so as to reduce emissions. The rate shaping control device includes an injection control valve positioned along a drain circuit connected to a control volume positioned at one end of the needle valve element. The injection control valve includes an actuator for controlling the flow of fuel through the drain circuit to variably control the rate of movement of the needle valve element between the open and closed positions so as to provide the desired shaping to the flow rate of fuel into the combustion chamber. The injection control valve may include a control valve element positioned in the control volume adjacent the needle valve element for cooperating with the needle valve element to control the drain flow of fuel through the drain circuit during the injection event. The needle valve element may include a valve surface wherein positioning of the control valve member relative to the valve surface controls drain flow through the drain circuit. The valve surface may be either a flat valve surface or a conically shaped surface for positive abutment by the control valve member, or alternatively, the needle valve element and the control valve member may be of the spool-type.

19 Claims, 6 Drawing Sheets

INJECTION RATE SHAPING NOZZLE ASSEMBLY FOR A FUEL INJECTOR

TECHNICAL FIELD

This invention relates to an improved nozzle assembly for fuel injectors which effectively controls the flow rate of fuel injected into the combustion chamber of an engine.

BACKGROUND OF THE INVENTION

In most fuel supply systems applicable to internal combustion engines, fuel injectors are used to direct fuel pulses into the engine combustion chamber. A commonly used injector is a closed-nozzle injector which includes a nozzle assembly having a spring-biased nozzle valve element positioned adjacent the nozzle orifice for resisting blow back of exhaust gas into the pumping or metering chamber of the injector while allowing fuel to be injected into the cylinder. The nozzle valve element also functions to provide a deliberate, abrupt end to fuel injection thereby preventing a secondary injection which causes unburned hydrocarbons in the exhaust. The nozzle valve is positioned in a nozzle cavity and biased by a nozzle spring to block fuel flow through the nozzle orifices. In many fuel systems, when the pressure of the fuel within the nozzle cavity exceeds the biasing force of the nozzle spring, the nozzle valve element moves outwardly to allow fuel to pass through the nozzle orifices, thus marking the beginning of injection. In another type of system, such as disclosed in U.S. patent application Ser. No. 686,491, now U.S. Pat. No. 5,676,114, filed Jul. 25, 1996, entitled *Needle Controlled Fuel System With Cyclic Pressure Generation* and commonly assigned to the assignee of the present invention, the beginning of injection is controlled by a servo-controlled needle valve element. The assembly includes a control volume positioned adjacent an outer end of the needle valve element, a drain circuit for draining fuel from the control volume to a low pressure drain, and an injection control valve positioned along the drain circuit for controlling the flow of fuel through the drain circuit so as to cause the movement of the needle valve element between open and closed positions. Opening of the injection control valve causes a reduction in the fuel pressure in the control volume resulting in a pressure differential which forces the needle valve open, and closing of the injection control valve causes an increase in the control volume pressure and closing of the needle valve. U.S. Pat. No. 5,463,996 issued to Maley et al. discloses a similar servo-controlled needle valve injector.

Internal combustion engine designers have increasingly come to realize that substantially improved fuel supply systems are required in order to meet the ever increasing governmental and regulatory requirements of emissions abatement and increased fuel economy. It is well known that the level of emissions generated by the diesel fuel combustion process can be reduced by decreasing the volume of fuel injected during the initial stage of an injection event while permitting a subsequent unrestricted injection flow rate. As a result, many proposals have been made to provide injection rate control devices in closed nozzle fuel injector systems. One method of controlling the initial rate of fuel injection is to spill a portion of the fuel to be injected during the injection event. For example, U.S. patent application Ser. No. 376,417, now U.S. Pat. No. 5,647,536, filed Jan. 23, 1995, entitled *Injection Rate Shaping Nozzle Assembly for a Fuel Injector* and commonly assigned to the assignee of the present application discloses a closed nozzle injector which includes a spill circuit formed in the needle valve element for spilling injection fuel during the initial portion of an injection event to decrease the quantity of fuel injected during this initial period thus controlling the rate of fuel injection. A subsequent unrestricted injection flow rate is achieved when the needle valve moves into a position blocking the spill flow causing a dramatic increase in the fuel pressure in the nozzle cavity. However, the needle valve is not servo-controlled and, thus, this nozzle assembly does not include a control volume for controlling the opening and closing of the needle valve. Moreover, the rate shaping nozzle assembly does not permit the rate to be selectively varied.

U.S. Pat. No. 5,133,645 to Crowley et al. discloses a common rail fuel injection system having two common rails serving respective banks of injectors. Fuel is supplied to each rail by a respective cam-operated reciprocating plunger pump. Each injector includes a nozzle element positioned in a spring cavity which receives high pressure fuel from the common rail via a check valve. The spring cavity is also connected, via an orifice, to a pressure control volume positioned above the nozzle element. A solenoid operated control valve opens to connect the control volume to drain thereby initiating injection as fuel flows from the nozzle cavity through the orifice to drain, and closes to terminate injection. U.S. Pat. No. 4,249,497 to Eheim et al. discloses a fuel injection system wherein fuel injection is controlled by controlling the differential pressure across a nozzle valve element using a single valve which opens to direct fuel to drain so as to start injection and closes to end injection. However, these references fail to disclose a means for achieving injection rate shaping.

U.S. Pat. No. 5,176,120 to Takahashi discloses a fuel injection system including a cam-operated fuel pump for supplying high pressure fuel to a common rail serving an injector. The injector includes a needle valve movable under the influence of differential fuel pressures as controlled by a solenoid-actuated valve. The system provides a control unit for achieving different fuel injection rates. However, the control unit must vary the pressure in the common rail to vary the fuel injection rate. When a lower common rail pressure is desired, the common rail fuel pressure is gradually lowered by the slow incremental extraction of fuel for injection without the addition of fuel to the rail. As a result, this system is incapable of quickly varying the pressure in the common rail to achieve a desired corresponding injection pressure and injection rate. Moreover, injection rate of each injector cannot be controlled independently. In addition, this system only permits two injection rate shapes thus limiting the effectiveness of the system. Also, the servo-controlled needle valve and actuator valve assembly is unnecessarily complex.

U.S. Pat. No. 2,959,360 to Nichols discloses a fuel injector nozzle assembly incorporating passages in the nozzle assembly for diverting the fuel from the nozzle assembly. Specifically, Nichols discloses a nozzle valve element having an axial passage formed therein for diverting fuel from the nozzle cavity into an expansible chamber formed in the nozzle valve element. A plunger is positioned in the chamber to form a differential surface creating a fuel pressure induced seating force on the nozzle valve element to aid in rapidly seating the valve element. The Nichols reference does not suggest the desirability of controlling the rate of injection.

Although some systems discussed hereinabove create different stages of injection, further improvement is desirable. None of the above discussed references disclose a fuel injector incorporating a simple, cost effective rate shaping device for a servo-controlled needle valve which minimizes the complexity of the nozzle assembly while effectively controlling emissions by controlling the rate of fuel injection.

SUMMARY OF THE INVENTION

It is an object of the present invention, therefore, to overcome the disadvantages of the prior art and to provide a nozzle assembly for a fuel injector which is capable of effectively and predictably controlling the rate of fuel injection It is another object of the present invention to provide a rate shaping nozzle assembly including a servo-controlled injector needle valve element capable of effectively controlling flow rate of fuel injected during each injection event so as to minimize emissions.

It is another object of the present invention to provide a nozzle assembly capable of shaping the rate of fuel injection which is also simple and inexpensive to manufacture.

It is yet another object of the present invention to provide a rate shaping nozzle assembly for an injector which effectively slows down the rate of fuel injection during the initial portion of an injection event while subsequently increasing the rate of injection to rapidly achieve a high injection pressure.

It is a further object of the present invention to provide an injector for use in a variety of fuel systems, including common rail system, accumulator pump systems and pump-line-nozzle fuel systems, which effectively controls the rate of injection at each cylinder location.

It is a still further object of the present invention to provide a rate shaping nozzle assembly which can be easily adapted for use in a unit injector.

Still another object of the present invention is to provide a rate shaping nozzle assembly for an injector which is capable of selectively creating a infinite number of injection rate shapes.

Yet another object of the present invention is to provide an injector which offers maximum flexibility in controlling injection rate shape.

These and other objects of the present invention are achieved by providing a closed nozzle injector for injecting fuel at high pressure into the combustion chamber of an engine, comprising an injector body containing an injector cavity and an injector orifice communicating with one end of the injector cavity to discharge fuel into the combustion chamber wherein the injector body includes a fuel transfer circuit for transferring supply fuel to the injector orifice. The injector also includes a nozzle valve element positioned in one end of the injector cavity adjacent the injector orifice and movable between an open position in which fuel may flow from the fuel transfer circuit through the injector orifice into the combustion chamber and a closed position in which fuel flow through the injector orifice is blocked. Movement of the nozzle valve element from the closed position to the open position and from the open position to the closed position defines an injection event during which fuel may flow through the injector orifice into the combustion chamber. The closed nozzle injector further includes a needle valve control device for moving the needle valve element between the open and closed positions. The needle valve control device includes a control volume positioned adjacent an outer end of the needle valve element, a control volume charge circuit for supplying fuel from the fuel transfer circuit to the control volume, a drain circuit for draining fuel from the control volume to a low pressure drain, and a rate shaping control device for producing a predetermined time varying change in the flow rate of fuel injected into the combustion chamber during the injection event. The rate shaping control device includes an injection control valve positioned along the drain circuit for controlling the flow of fuel through the drain circuit to variably control the rate of movement of the needle valve element between the open and closed positions. The injection control valve is operable to create a low injection flow rate through the injector orifice followed by a high injection flow rate greater than the low injection flow rate during the injection event.

The injection control valve may include a reciprocally mounted control valve member selectively movable into more than two positions. The injection control valve may include an actuator for selectively moving the control valve member relative to the needle valve element. The actuator is capable of moving the control valve element at a predetermined variable rate to create the low injection flow rate followed by the high injection flow rate so as to provide the desired shaping to the flow rate of fuel into the combustion chamber. The control valve element may be positioned in the control volume adjacent the needle valve element for cooperating with the needle valve element to control the drain flow of fuel through the drain circuit during the injection event. The needle valve element may include a valve surface wherein positioning of the control valve member relative to the valve surface controls drain flow through the drain circuit. The valve surface may be formed on the outer end of the nozzle valve element. The control valve member may be positioned in compressive abutment against the valve surface when in a closed positioned to block flow through the drain circuit. The valve surface may be either a flat valve surface or a conically shaped surface in the embodiment having a positive valve seat. Alternatively, the needle valve element and the control valve member may be telescopingly received within one another. Preferably, in this embodiment, the outer end of the needle valve element includes a cylindrical recess for receiving the control valve member. The control valve member, or the needle valve element, may include a drain port formed adjacent the valve surface such that reciprocal movement of the control valve member in the cylindrical recess relative to the needle valve element controls the flow through the drain port. The control valve member may include an elongated portion having an axial passage extending therethrough for draining fuel. The elongated portion may be tubular in shape having a large central axial passage. The elongated portion is mounted in a cylindrical bore formed in the injector body to form a fluid seal between the elongated portion and the injector body.

DETAILED DESCRIPTION OF THE PREFERRED EMBODIMENT

Throughout this application, the words "inward", "innermost", "outward" and "outermost" will correspond to the directions, respectively, toward and away from the point at which fuel from an injector is actually injected into the combustion chamber of an engine. The words "upper" and "lower" will refer to the portions of the injector assembly which are, respectively, farthest away and closest to the engine cylinder when the injector is operatively mounted on the engine.

Figure 1:
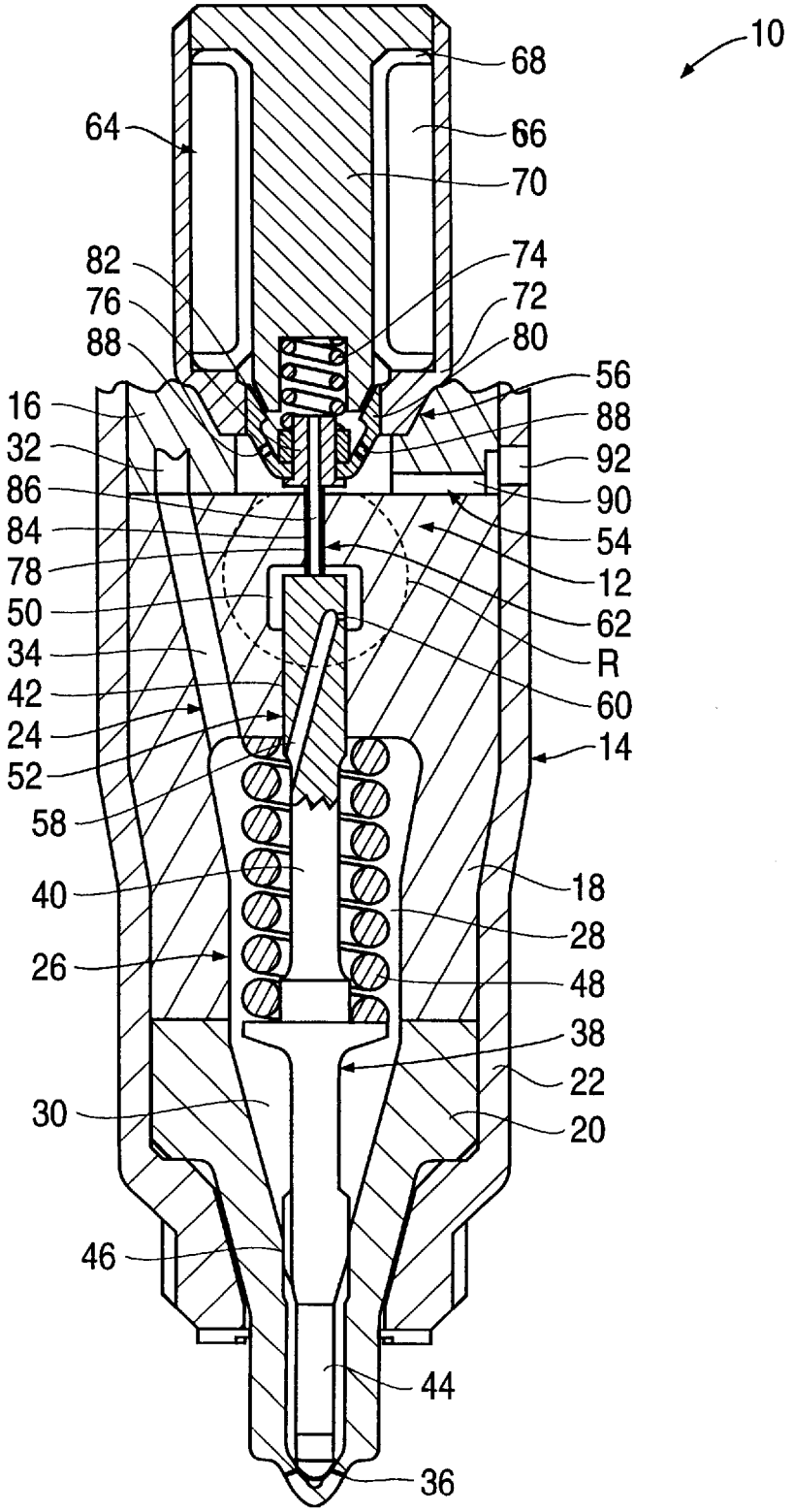
FIG. 1 is an enlarged, partial cross sectional view of the injection rate shaping nozzle assembly of the present invention incorporated into a fuel injector.

Referring to FIG. 1, there is shown a closed nozzle injector, indicated generally at 10, incorporating the needle valve control device 12 of the present invention. Closed nozzle injector 10 generally includes an injector body 14 formed from a spacer 16, a spring housing 18, a nozzle housing 20 and a retainer 22. The spring housing 18 and nozzle housing 20 are held in compressive abutting relationship in the interior of retainer 22. For example, the outer end of retainer 22 may contain internal threads (not shown) for engaging corresponding external threads on spacer 16 or an additional body component positioned outward from spacer 16, to permit the entire injector body 14 to be held together by simple relative rotation of retainer 22 with respect to the outer threaded component.

Injector body 14 includes an injector cavity, indicated generally at 26, which includes a spring cavity 28 formed in spring housing 18 and a nozzle cavity 30 formed in nozzle housing 20. Injector body 14 further includes a fuel transfer circuit 24 comprised of delivery passages 32 and 34 formed in spacer 16 and spring housing 18, respectively, for delivering fuel from a high pressure source to spring cavity 28 and nozzle cavity 30. Injector body 14 also includes one or more injector orifices 36 fluidically connecting nozzle cavity 30 with a combustion chamber of an engine (not shown).

Closed nozzle fuel injector 10 also includes a needle valve element 38 including an outer portion 40 slidably positioned in an outer bore 42 formed in spring housing 18 and an inner portion 44 slidably positioned in an inner bore 46 formed in nozzle housing 20. A biasing spring 48 positioned in spring cavity 28 abuts a spring seat formed on inner portion 44 so as to bias needle valve element 38 into a closed position blocking fuel flow through injector orifices 36.

The injection rate shaping nozzle assembly of the present invention can be adapted for use with a variety of injectors and fuel systems. For example, closed nozzle injector 10 may receive high pressure fuel from a high pressure common rail or alternatively, a dedicated pump assembly, such as in a pump-line-nozzle system or a unit injector system incorporating, for example, a mechanically actuated plunger into the injector body. The injection rate shaping nozzle assembly of the present invention may also be incorporated into the fuel injectors and fuel system disclosed in U.S. patent application Ser. No. 686,491, filed Jul. 25, 1996, entitled *Needle Controlled Fuel System With Cyclic Pressure Generation*, the entire contents of which is hereby incorporated by reference. Thus, injection rate shaping nozzle assembly of the present invention may be incorporated into any fuel injector or fuel system which supplies high pressure fuel to fuel transfer circuit 24 while permitting needle valve control device 12 to control the timing, quantity and rate shape of the fuel injected into the combustion chamber.

Needle valve control device 12 functions to control the movement of needle valve element 38 between its open position allowing fuel flow through injector orifices 36 and its closed position blocking flow through injector orifices 36. Specifically, needle valve control device 12 operates to initiate the beginning of movement of needle valve element 38 from one of its positions to the other while also variably controlling the movement, i.e. rate of movement, of needle valve element 38 as it moves between open and close positions. In this manner, needle valve control device 12 functions as a rate shaping control device for producing a predetermined time varying change in the flow rate of fuel injected into the combustion chamber during an injection event so as to improve combustion and minimize emissions.

Needle valve control device 12 includes a control volume or cavity 50 formed in spring housing 18 at the outer end of outer bore 42 for receiving an outer end of needle valve element 38 and a control volume charge circuit 52 for directing fuel from spring cavity 28 into control volume 50. Needle valve control device 12 also includes a drain circuit 54 formed partially in injector body 14 for draining fuel from control volume 50 and an injection control valve 56 positioned along drain circuit 54 for variably controlling the flow of fuel through drain circuit 54 so as to cause controlled, predetermined movement of needle valve element 38. As discussed hereinbelow, injection control valve 56 is specifically designed to enable precise control over the movement of needle valve element 38 from its closed to its open position so as to predictably control the flow of fuel through injector orifices 36 for achieving a desired injection rate shape.

Control volume charge circuit 52 includes an angled passage 58 extending generally axially through outer portion 40 of needle valve element 38 from spring cavity 28 and an orifice 60 extending transversely from the outer end of angled passage 58 to communicate with control volume 50 during all positions of needle valve element 38. As shown in FIG. 1, injection control valve 56 includes a control valve member 62 and an actuator assembly 64 for selectively moving control valve member 62 through a predetermined variable lift schedule so as to precisely control the movement of needle valve element 38. Actuator assembly 64 may be any type of actuator assembly capable of selectively controlling the movement of control valve member 62 relative to needle valve element 38 with a high degree of precision. For example, a fast proportional actuator, such as an electromagnetic, magnetostrictive or piezoelectric type, could be used to move control valve member 62 in proportion to the magnitude of the input signal to the actuator, i.e. voltage, current, etc. In the electromagnetic embodiment shown in FIG. 1, actuator assembly 64 includes a coil 66 mounted on a bobbin 68 secured to a stator 70. An actuator support 72 is secured to the inner end of actuator 64 for abutment against spacer 16. Stator 70 includes a recess for receiving a bias spring 74 for biasing control valve member 62 inwardly away from stator 70. Control valve member 62 includes a mounting portion 76 and an elongated portion 78 extending from mounting portion 76 inwardly. Actuator assembly 64 further includes an armature 80 mounted on mounting portion 76 via a retainer 82. Retainer 82 may be any form of securing device such as a threaded nut or crimping device capable of securing armature 80 to control valve member 62. Thus, by this arrangement, when actuator assembly 64 is de-energized, armature 80 and control valve member 62 are biased inwardly away from stator 70, and when actuator assembly 64 is energized, armature 80 and control valve member 62 are pulled outwardly toward stator 70.

Elongated portion 78 of control valve member 62 extends through a complementary shaped bore 84 formed in spring housing 18. Elongated portion 78 extends completely through bore 84 into control volume 50 for cooperation with the outer end of needle valve element 38. Drain circuit 54 includes an axial passage 86 extending through both mounting portion 76 and elongated portion 78 of control valve member 62 and opening at each end of member 62. Drain circuit 54 also includes passages 88 formed in armature 80 for directing flow from the inner extent of armature to the space surrounding armature 80. Moreover, drain circuit 54 includes a transverse passage 90 and a drain port 92 for directing fuel to a low pressure drain.

Figure 2A:
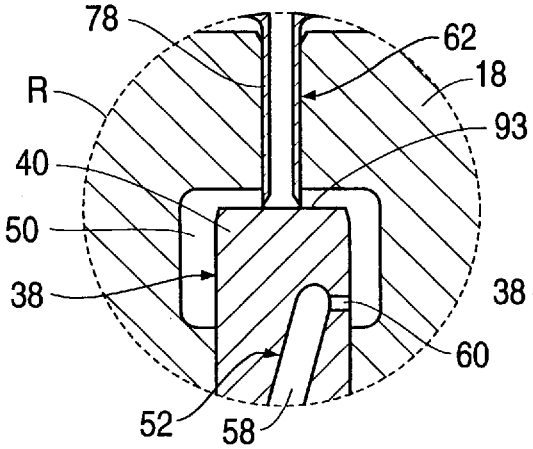
FIGS. 2*a*–2*d* are expanded views of the area R of FIG. 1.
Figure 2B:
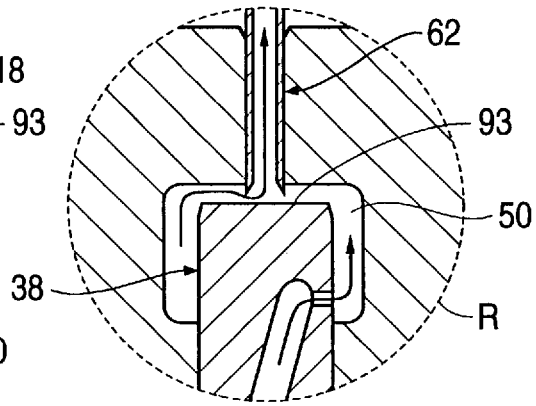
Figure 2C:
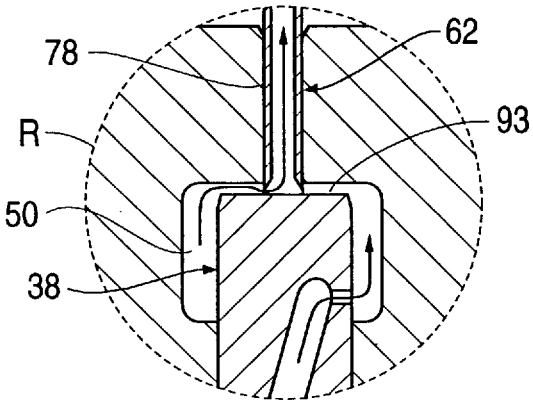
Figure 2D:
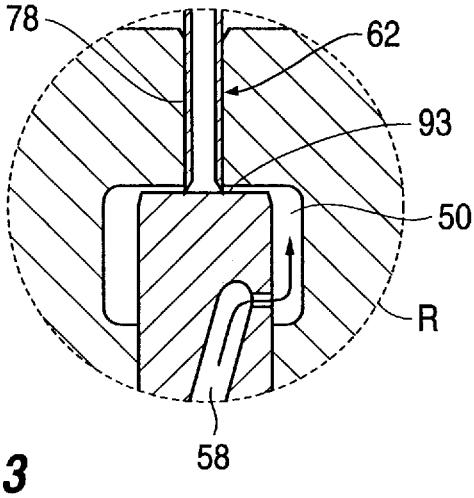

During operation, prior to an injection event, injection control valve 56 is de-energized causing control valve member 62 to be positioned in sealed abutment against a flat valve surface or seat 93 formed on the outer end of needle valve element 38. The fuel pressure level experienced in spring cavity 28 and nozzle cavity 30 is also present in control volume charge circuit 52 and control volume 50, since drain flow through axial passage 86 is blocked by the cooperation of control valve member 62 with needle valve element 38. As a result, the fuel pressure forces acting inwardly on needle valve element 38, in combination with the bias force of spring 48, maintain needle valve element 38 in its closed position blocking flow through injector orifices 36 as shown in FIGS. 1 and 2*a*. At a predetermined time during the supply of high pressure fuel to spring cavity 18 and nozzle cavity 20 via fuel transfer circuit 24, actuator assembly 64 is energized to controllably move control valve member 62 from the position shown in FIG. 2*a* to an open position shown in FIG. 2*b*. The movement of control valve member 62 follows a predetermined lift schedule which varies the rate of movement of control valve member 62 so as to controllably vary the distance between control valve member 62 and valve surface 93 thus varying the drain flow from control volume 50 which ultimately permits precise control over the movement of needle valve element 38 between its closed and open positions. As control valve member 62 is lifted from valve surface, fuel flows from control volume 50 through axial drain passage 86, passage 90 and drain port 92 to the low pressure drain. Simultaneously, high pressure fuel flows from spring cavity 28 through angled passage 58 and orifice 60 into control volume 50. However, orifice 60 is designed with a smaller cross sectional flow area than drain circuit 54 and thus a greater amount of fuel is drained from control volume 50 than is replenished via control volume charge circuit 52. As a result, the pressure in control volume 50 immediately decreases. Fuel pressure forces acting on needle valve element 38 due to the high pressure fuel in spring cavity 28 and nozzle cavity 30, begin to move valve element 38 outwardly against the bias force of spring 48. As the outer end of needle valve element 38 approaches the inner end of elongated portion 78 of needle valve element 38, the drain flow from control volume 50 into axial passage 86 is gradually decreased. However, the flow into control volume 50 via control volume charge circuit 32 continues thus raising the pressure in control volume 50. At a certain pressure level, the pressure forces acting on the outer end of needle valve element 38 in control volume 50 will combine with biasing spring 48 so as to begin to urge needle valve element 38 toward its closed position. This action will in turn begin to move valve surface 93 away from control valve member 62 increasing the drain flow. Thus, needle valve element 38 will reach an equilibrium position permitting a small amount of drain flow from control volume 50 to compensate for the charge flow entering control volume 50 so as to automatically maintain needle valve element 38 in its open position as shown in FIG. 2*c*. After a predetermined time period, actuator assembly 64 is de-energized causing bias spring 74 to move control valve member 62 into sealing abutment with valve surface 93 of needle valve element 38 as shown in FIG. 2*d*. As a result, the pressure in control volume 50 increases so as to move needle valve element 38 to its closed position thus ending injection.

Figure 4:
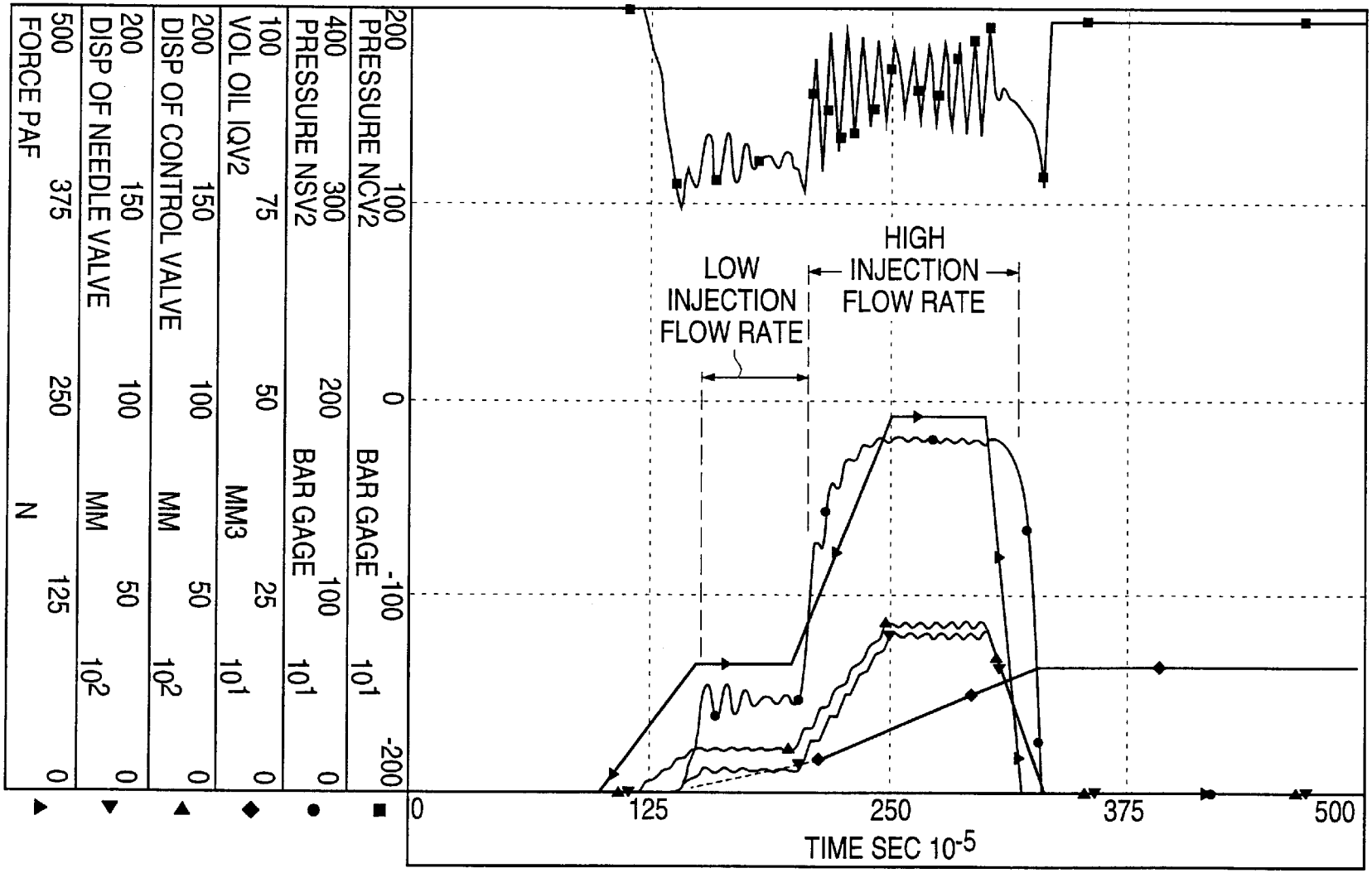
FIG. 4 is a graph showing various fuel pressures and quantities, and valve displacements, during an injection event created by the injector of FIG. 1.

An important feature of the present invention is the ability of injection control valve 56 to precisely and reliably control the movement of needle valve element 38 to achieve desired injection rate shaping during an injection event. Injection control valve 56 functions as a rate shaping control device by utilizing actuator assembly 64 which is designed to precisely and variably control the movement of control valve member 62. Specifically, when actuator assembly 64 is energized, control valve member 62 is pulled outwardly away from valve surface 93 toward an outermost position as shown in FIG. 2*b*. In response, needle valve element 38 moves outwardly toward control valve member 62, essentially following, or tracking, the movement of control valve member 62. As shown in FIG. 4, the displacement of needle valve element 38 essentially tracks the movement or displacement of control valve member 62 over time. Actuator assembly 64 is operated so as to reduce the rate of outward movement of control valve member 62, even to the extent of temporarily terminating the outward movement, during the initial stage of outward movement, so as to limit the initial movement of needle valve element 38 to create a low injection flow rate, by throttling fuel flow through injector orifices, and then subsequently causing the full outward movement of control valve member 62 and thus needle valve element 38 to create the high injection flow rate as shown in FIG. 4. With respect to FIG. 4, it should be noted that the injection flow rate is proportional to the injection pressure at the injector orifices. By providing an actuator capable of variably controlling the movement of valve member 62 with precision, the injection control valve 56 of the present invention is capable of automatically controlling the movement of needle valve element 38 in a predetermined manner so as to achieve an optimum injection flow rate shape for a given set of engine conditions. In addition, by positioning control valve member 62 for cooperation with valve surface 93 on the outer end of needle valve element 38, the position of needle valve element 38 is automatically regulated and controlled without the need for a separate feedback control device. In other words, the precise control of the movement of control valve member 62 automatically regulates and achieves the desired movement of needle valve element 38 necessary to achieve the rate shaping desired.

Figure 3:
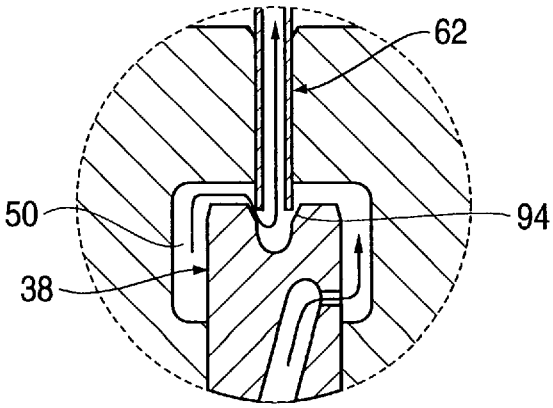
FIG. 3 is an expanded view of an area similar to FIGS. 2*a*–2*d* illustrating a second embodiment of the valve surface.

Referring to FIG. 3, a second embodiment of the needle valve control device of the present invention is illustrated which is similar to the embodiment of FIG. 1 except that a conically shaped valve surface or seat 94 is formed in the outer end of needle valve element 38, instead of a flat surface as shown in the first embodiment. This embodiment operates in the same manner as the embodiment shown in FIG. 1. However, the conically shaped valve surface 84 functions to decrease the rate of change of the cross sectional flow area between control valve member 62 and valve surface 94 during the initial movement of control valve member 62 away from valve surface 94. This design results in more controlled, stable movement of needle valve element 38. Although this design may also result in a slower response in movement of needle valve element 38, the increase in the control of movement of needle valve element 38 may be desirable in certain applications.

Figure 5A:
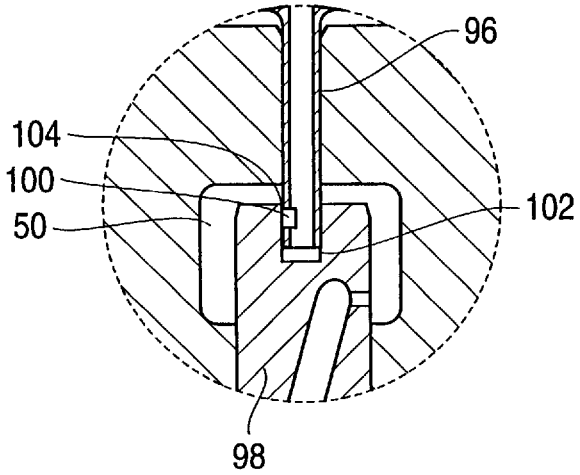
FIGS. 5*a*–5*d* are expanded views of the area of a second embodiment of the present invention illustrating a spool-type control valve member and needle valve element in various positions.
Figure 5B:
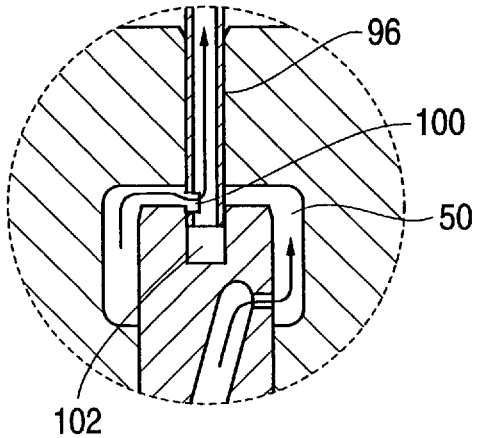
Figure 5C:
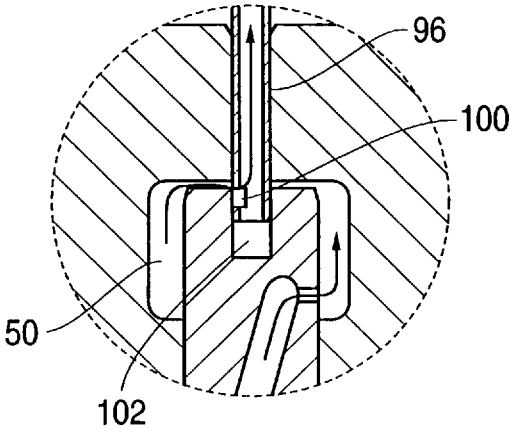
Figure 5D:
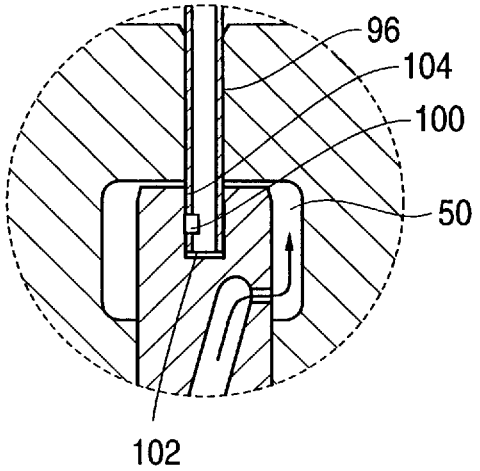
Figure 6:
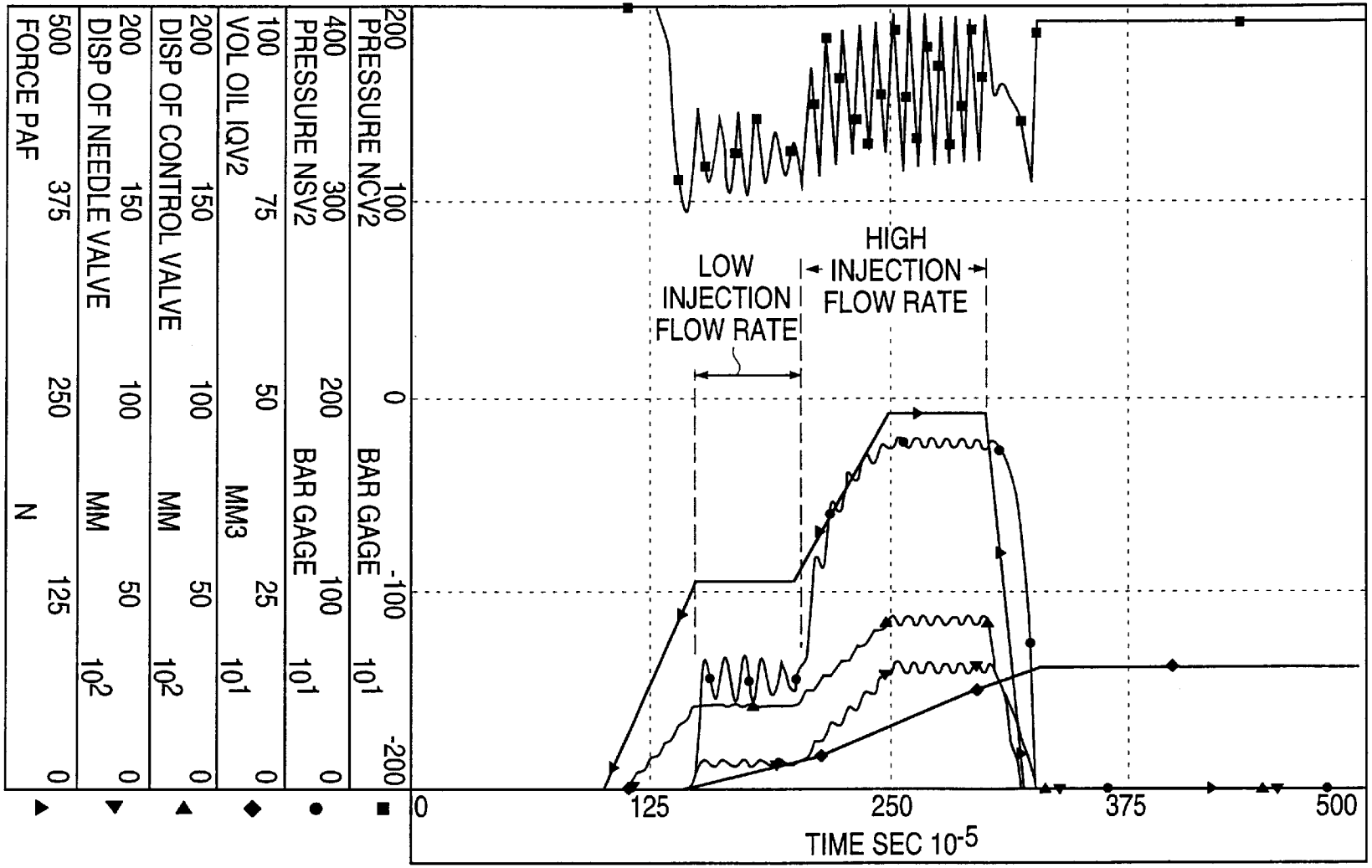
FIG. 6 is a graph showing various fuel pressures and quantities, and valve displacements, during an injection event created by the embodiment shown in FIGS. 5*a*–5*d*.

FIGS. 5*a*–5*d* illustrate yet another embodiment of the present invention incorporating spool-type valve cooperation between a control valve member 96 and a needle valve element 98, instead of the positive seated design of the embodiments shown in FIGS. 1 and 3. In the present embodiment, a drain port 100 is formed in the wall of control valve member 96 so as to permit communication between control volume 50 and axial passage 86. Needle valve element 98 includes a cylindrical recess 102 sized so as to slidably receive the inner end of control valve member 96 to form a fluid seal between the outer surface of control valve member 96 and the inner surface of cylindrical recess 102. Thus, drain port 100 functions as part of the drain circuit while control valve member 96 and needle valve element 98 move relative to one another to vary the flow through drain port 100. As shown in FIG. 5*a*, with actuator assembly 64 de-energized and needle valve element 98 in the closed position, drain port 100 is positioned so as to be completely closed by needle valve element 98 so as to block flow into drain port 100 from control volume 50. Upon energization of the actuator, control valve member 96 is moved outwardly to permit fluid flow from control volume 50 through drain port 100 into axial passage 86 as shown in FIG. 5*b*. As discussed hereinabove with respect to the embodiment of FIG. 1, needle valve element 98 tracks the movement of control valve member 96 resulting in a state of dynamic equilibrium with needle valve element 98 in an outermost open position as shown in FIG. 5*c*. After a predetermined time period, the actuator is de-energized into the position shown in FIG. 5*d* where upon needle valve element 98 will begin to move toward the closed position. It should be noted that drain port 100 must be formed at a position along control valve member 96 so as to create a sufficient sealing length along the valve surface created by the overlapping of control valve member 96 and needle valve element 98 adjacent port 100, indicated at 104, so as to sufficiently prevent leakage through the valve surface sealing length 104 when in the closed position. As shown in FIG. 6, the present spool-type embodiment functions substantially in the same manner as the first embodiment to automatically and precisely regulate the movement of needle valve element 98 so as to achieve a low injection flow rate followed by a high injection flow rate. In addition, as can be seen by a comparison of FIGS. 4 and 6, the present spool-type embodiment causes a more rapid closing of needle valve element 98 resulting in a sharper end of injection. Also, in the present embodiment, the tolerances between the outer diameter of outer portion 40 of needle valve element 38 and the inner diameter of outer bore 42 may be larger to permit alignment of cylindrical recess 102 and control valve member 96.

Figure 7:
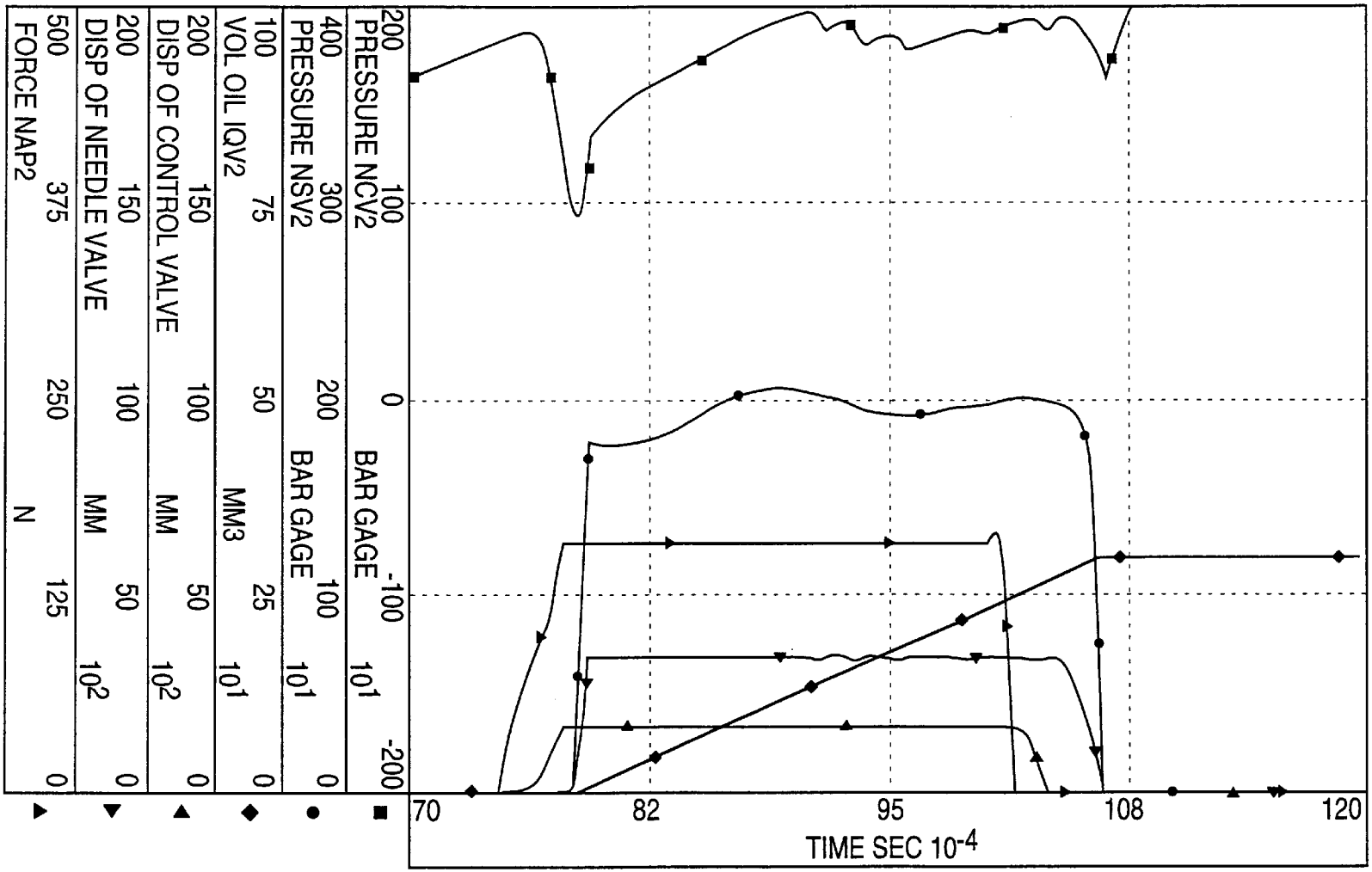
FIG. 7 PRIOR ART
FIG. 7 is a graph showing various fuel pressures and quantities, and valve displacements, during an injection event created by a conventional servo-controlled closed nozzle injector assembly.

The present invention results in significant advantages over conventional closed nozzle assemblies. Conventional servo-controlled closed nozzle valve assemblies having a control volume and an injection control valve such as disclosed in U.S. patent application Ser. No. 686,491, filed Jul. 25, 1996, entitled *Needle Controlled Fuel System With Cyclic Pressure Generation*, do not permit rate shaping and merely result in the injection characteristics shown in FIG. 7. In comparison, the present system permits the injection flow rate to be selectively and variably shaped to achieve an optimum reduction in emissions for each of a variety of engines and operating conditions. For example, the low injection flow rate, which has been recognized as beneficial to reducing emissions, can be achieved at different times during the injection event. Also, the magnitude of the low injection flow rate can be precisely controlled and varied by controlling the movement of control valve member 62, 96. Thus, an infinite number of fuel injection flow rate shapes can be achieved. Moreover, the present invention provides a simple, effective device for precisely controlling needle valve element movement without the need for a complex feedback system to detect and adjust the position of the element. In addition, the present invention permits effective injection flow rate shaping by controllably throttling the fuel flow through the needle valve element seat without the need for varying the pressure delivered to the nozzle cavity as required by some conventional systems.

INDUSTRIAL APPLICABILITY

It is understood that the present invention is applicable to all internal combustion engines utilizing a fuel injection system and to all closed nozzle injectors including unit injectors. This invention is particularly applicable to diesel engines which require accurate fuel injection rate control by a simple rate control device in order to minimize emissions. Such internal combustion engines including a fuel injector in accordance with the present invention can be widely used in all industrial fields and non-commercial applications, including trucks, passenger cars, industrial equipment, stationary power plant and others.

I claim:

1. A closed nozzle injector for injecting fuel at high pressure into the combustion chamber of an engine, comprising:

an injector body containing an injector cavity and an injector orifice communicating with one end of said injector cavity to discharge fuel into the combustion chamber, said injector body including a fuel transfer circuit for transferring supply fuel to said injector orifice;

a nozzle valve element positioned in one end of said injector cavity adjacent said injector orifice, said nozzle valve element movable between an open position in which fuel may flow from said fuel transfer circuit through said injector orifice into the combustion chamber and a closed position in which fuel flow through said injector orifice is blocked, movement of said nozzle valve element from said closed position to said open position and from said open position to said closed position defining an injection event during which fuel may flow through said injector orifice into the combustion chamber;

a needle valve control means for moving said needle valve element between said open and said closed positions, said needle valve control means including a control volume positioned adjacent an outer end of said needle valve element, a control volume charge circuit for supplying fuel from said fuel transfer circuit to said control volume, a drain circuit for draining fuel from said control volume to a low pressure drain, and a rate shaping control means for producing a predetermined time varying change in the flow rate of fuel injected into the combustion chamber during said injection event, said rate shaping control means including an injection control valve positioned along said drain circuit for controlling the flow of fuel through said drain circuit to variably control the rate of movement of said needle valve element between said open and said closed positions, said injection control valve operable to create a low injection flow rate through said injector orifice followed by a high injection flow rate greater than said low injection flow rate during said injection event, said injection control valve including a reciprocally mounted control valve member and an actuator for selectively moving said control valve member relative to said needle valve element, said actuator capable of moving said control valve member at a predetermined variable rate to create said low injection flow rate and said high injection flow rate.

2. The closed nozzle injector of claim 1, wherein said injection control valve includes a reciprocally mounted control member selectively movable into more than two positions.

3. The closed nozzle injector of claim 1, wherein said control valve member is positioned in said control volume adjacent said needle valve element for cooperating with said needle valve element to control the drain flow of fuel through said drain circuit during said injection event.

4. The closed nozzle injector of claim 3, wherein said needle valve element includes a valve surface and positioning of said control valve member relative to said valve surface controls drain flow through said drain circuit.

5. The closed nozzle injector of claim 4, wherein said valve surface being formed on said outer end of said needle valve element, said control valve member positioned in compressive abutment against said valve surface in a closed position to block flow through said drain circuit.

6. The closed nozzle injector of claim 5, wherein said valve surface is a flat surface.

7. The closed nozzle injector of claim 5, wherein said valve surface is a conically shaped.

8. The closed nozzle injector of claim 4, wherein said outer end of said needle valve element includes a cylindrical recess, said control valve member extending into said cylindrical recess, one of said control valve member and said needle valve element including a drain port, said valve surface being formed adjacent said drain port, wherein said control valve member reciprocally moves in said cylindrical recess relative to said needle valve element to control flow through said drain port.

9. The closed nozzle injector of claim 1, wherein said control valve member includes a, elongated portion, said drain circuit including an axial passage extending through said elongated portion.

10. The closed nozzle injector of claim 9, wherein said elongated portion is tubular shaped and reciprocally mounted in a cylindrical bore formed in said injector body to form a fluid seal between said elongated portion and said injector body.

11. A closed nozzle injector for injecting fuel at high pressure into the combustion chamber of an engine, comprising:

an injector body containing an injector cavity and an injector orifice communicating with one end of said injector cavity to discharge fuel into the combustion chamber, said injector body including a fuel transfer circuit for transferring supply fuel to said injector orifice;

a nozzle valve element positioned in one end of said injector cavity adjacent said injector orifice, said nozzle valve element movable between an open position in which fuel may flow from said fuel transfer circuit through said injector orifice into the combustion chamber and a closed position in which fuel flow through said injector orifice is blocked, movement of said nozzle valve element from said closed position to said open position and from said open position to said closed position defining an injection event during which fuel may flow through said injector orifice into the combustion chamber;

a needle valve control means for moving said needle valve element between said open and said closed positions, said needle valve control means including a control volume positioned adjacent an outer end of said needle valve element, a control volume charge circuit for supplying fuel from said fuel transfer circuit to said control volume, a drain circuit for draining fuel from said control volume to a low pressure drain, and an injection control valve positioned along said drain circuit for controlling the flow of fuel through said drain circuit to variably control the rate of movement of said needle valve element between said open and said closed positions, wherein said injection control valve includes a reciprocally mounted control valve member positioned in said control volume adjacent said needle valve element for cooperating with said needle valve element to control the drain flow of fuel through said drain circuit during said injection event, said injection control valve including an actuator for selectively moving said control valve member relative to said needle valve element.

12. The closed nozzle injector of claim 11, wherein said injection control valve controls the drain flow of fuel through said drain circuit so as to produce a predetermined time varying change in the flow rate of fuel injected into the combustion chamber during said injection event, said injection control valve operable to create a low injection flow rate through said injector orifice followed by a high injection flow rate greater than said low injection flow rate during said injection event.

13. The closed nozzle injector of claim 12, wherein said actuator is capable of moving said control valve member at a predetermined variable lift rate to create said low injection flow rate and said high injection flow rate.

14. The closed nozzle injector of claim 13, wherein said needle valve element includes a valve surface and positioning of said control valve member relative to said valve surface controls drain flow through said drain circuit.

15. The closed nozzle injector of claim 14, wherein said valve surface is includes a valve seat formed on said outer end of said needle valve element, said control valve member being positioned in compressive abutment against said valve surface when in a closed position to block flow through said drain circuit.

16. The closed nozzle injector of claim 15, wherein said valve seat is a flat surface.

17. The closed nozzle injector of claim 16, wherein said valve seat is a conically shaped.

18. The closed nozzle injector of claim 14, wherein said outer end of said needle valve element includes a cylindrical recess, said control valve member extending into said cylindrical recess, one of said control valve member and said needle valve element including a drain port, said valve surface being formed adjacent said drain port, wherein said control valve member reciprocally moves in said cylindrical recess relative to said needle valve element to control flow through said drain port.

19. The closed nozzle injector of claim 11, wherein said control valve member includes a elongated portion, said drain circuit including an axial passage extending through said elongated portion.

* * * * *